United States Patent [19]

Lacy

[11] Patent Number: 4,844,145

[45] Date of Patent: Jul. 4, 1989

[54] BENDING OF CONTINUOUSLY CAST STEEL WITH CORRUGATED ROLLS TO IMPART COMPRESSIVE STRESSES

[75] Inventor: John P. Lacy, Baytown, Tex.

[73] Assignee: Steel Metallurgical Consultants, Inc., Houston, Tex.

[21] Appl. No.: 116,559

[22] Filed: Nov. 3, 1987

[51] Int. Cl.[4] ..... B22D 11/12

[52] U.S. Cl. ..... 164/476; 164/417; 164/442; 29/527.7

[58] Field of Search ..... 164/417, 442, 448, 476, 164/477; 148/2; 29/527.7; 72/168, 197, 196

[56] References Cited

U.S. PATENT DOCUMENTS

| | | | |
|---|---|---|---|
| 857,983 | 6/1907 | Cowles | 72/366 |
| 1,422,532 | 7/1922 | Breit | 164/417 |
| 2,143,336 | 4/1936 | Walton | 164/428 |
| 2,406,838 | 6/1943 | Kepler | 72/366 |
| 3,036,622 | 5/1962 | Hitz | 153/32 |
| 3,119,289 | 1/1964 | Bach | 8.0/5.1 |
| 3,365,791 | 1/1968 | Olsson | 29/528 |
| 3,483,915 | 12/1969 | Schneckenburger et al. | 164/476 |
| 3,592,727 | 7/1971 | Weaver et al. | 161/168 |
| 3,707,180 | 12/1972 | Vogt | 161/82 |
| 3,742,748 | 7/1973 | Ehm | 72/166 |
| 3,893,503 | 7/1975 | Eibl | 164/442 |
| 4,003,236 | 1/1977 | Quehen | 72/366 |
| 4,043,382 | 8/1977 | Saito et al. | 164/476 |
| 4,385,511 | 5/1983 | Vydrin | 72/205 |
| 4,433,717 | 2/1984 | Suzuki et al. | 164/454 |
| 4,465,121 | 8/1984 | Vaterlaus | 164/484 |
| 4,476,915 | 10/1984 | Rahmfeld et al. | 164/484 |
| 4,501,314 | 2/1985 | Wakabayashi et al. | 164/441 |
| 4,597,278 | 7/1986 | Hamada et al. | 72/196 |
| 4,625,536 | 12/1986 | Morooka | 72/249 |

FOREIGN PATENT DOCUMENTS

| | | | |
|---|---|---|---|
| 49595 | 7/1921 | Sweden | 72/197 |
| 1018784 | 5/1983 | U.S.S.R. | 164/448 |

*Primary Examiner*—Richard K. Seidel

*Attorney, Agent, or Firm*—Pravel, Gambrell, Hewitt, Kimball & Krieger

[57] ABSTRACT

An improved process for continuously casting a strand of steel comprising the bending of the steel with at least one corrugated roll. The strand is preferably pushed between a corrugated roll and a smooth roll by gravity or drive rolls to impact only compressive stresses to the strand. A curved strand cast with a curved mold can be straightened between two corrugated rolls having different surface corrugations to impart compressive stresses.

12 Claims, 5 Drawing Sheets

BENDING OF CONTINUOUSLY CAST STEEL WITH CORRUGATED ROLLS TO IMPART COMPRESSIVE STRESSES

BACKGROUND OF THE INVENTION

This invention relates to a method of bending a strand of steel in the vertical continuous casting process. Furthermore, the method relates to the use of corrugated rolls that work the surface of the steel strand.

The steel manufacturing practice for products which eventually were to be wrought or shaped by rolling to finished size, has been to cast the steel into ingots, a convenient intermediate form, which are further converted on primary mills to slabs or blooms suitable for finishing mill rolling. During the past thirty years, one of the most significant changes in the steel manufacturing process was the continuous casting of molten steel into shapes equivalent in section to conventional semi-finished shapes eliminating the ingot and primary mill stages.

Referring to FIG. 1, the basic construction of vertical continuous casting machines requires that molten metal be poured vertically into an oscillating water-cooled copper mold 10. With each oscillation of the mold 10 vertically an increment of solid steel 12 is attached to the existing strand shell 14 which is proceeding downward at the casting velocity. Each attachment of the initial ring of solid steel is recorded as an oscillation mark on the strand shell 14, with one mark made during each oscillation of the mold 10. These marks constitute stress risers and increase the sensitivity of the strand to creation of oscillator transverse cracks under tension stresses.

Referring now to FIG. 12, some early continuous casters produced a straight vertical strand but this design has given way to machines which requires less building height by converting the strand from the vertical to a horizontal path by either bending and unbending or casting into a curved mold (not shown) and restraightening. In the case of casters having straight molds 10, the strand is bent at some distance from the bottom of the mold into a curve configuration and at an additional distance bent in the reverse direction to emerge from the casting machine straight and horizontal. In the case of casters having curved molds (not shown), the strand emerges from the mold with curvature and requires only one straightening or bending operation to become flat and horizontal.

In existing continuous casters the forces for bending and restraightening are mechanical and are applied to the strand as it moves downward between a series of guide rolls positioned in a curved path. Typically, after the strand leaves the mold 10 it is cooled by water sprays (not shown) and travels vertically to allow for thickening of the solid shell 14 containing the internal molten metal 16. The strand then enters a driven pinch roll section 11 which withdraws the strand from the mold 10 and controls the speed of the line. Some of these pinch rolls are lightly knurled or serrated to assist in gripping the slab. The strand next enters the curved section in which the bending rolls 13 form the bend. The operation of these bending rolls is represented schematically by rolls 20, 22, 24 in FIG. 1. They are supported by back-up rolls as shown in FIG. 12 to prevent roll bending or flexing under the additional forces required to bend the strand.

After bending, the strand is guided through the remaining rolls 15 of the curved section, which includes additional sets of pinch drive rolls, to maintain curvature. As the strand emerges from the curved section, at floor level, it is bent in the reverse direction by the rolls 30, 32, 34 of the straightening machine 17 to become flat and horizontal. Shown schematically in FIG. 3, the rolls 30, 32, 34 of the straightening machine are larger in diameter than all of the previously described rolls in order to apply the additional forces required to bend the strand at reduced temperatures. Referring again to FIG. 12, a typical straightening machine has two pinch roll sets 31, 33 with openings set to the gauge of the strand at the entry and exit ends of the machine. Three intermediate rolls 30, 32, 34, positioned like an inverted triangle, bend the strand as a simple beam in the reverse direction of the strand curvature. The unbending load is applied by the two top rolls 30, 34 positioned approximately six feet apart and the bottom roll 32 located lengthwise midway approximately 3 feet between the two top rolls 30, 34. The top rolls 30, 34 have the adjustment capability to push the bottom of the strand below the roll pass line to allow for elastic springback of the strand.

The mechanical forces applied to the strand by the rolls 20, 22, 24 of the initial strand bender and the rolls 30, 32, 34 of the unbender, or straightening machine, treat the strand as a simple beam supported at the ends with a concentrated load applied at the center. This loading of the strand, or the bending moment, develops compressive stresses on the strand surface fibers at the point of center loading and tension stresses on the opposite strand surface. This type of loading is designed into the machine. In situations where the initial bender does not bend the strand to the desired curvature, the strand will further have tension stresses on either the top or the bottom surface while passing through the curved section of rolls, dependent upon the direction of out-of-curvature. This is because the curved section of rolls are trying to bend the slab to its desired radius. This additional stress can be crucial to subsequent crack failures. Although the straightening machine is primarily designed to remove upward curvature of the strand it has the capability to remove downward curvature by applying tension stresses to either or both surfaces.

The steel strand produced by the conventional continuous casting process has all the undesirable characteristics of steel castings such as a microstructure of large dendrites and large grain size in addition to internal stresses created during solidification as it is being pulled through the mold 10. Compounding the weakness of the steel are the effects of the oscillator mark stress risers resulting in a bending member highly sensitive to rupture under any source of tensile strain.

The process of casting into an oscillating mold 10 and bending and unbending the strand has resulted in many quality problems heretofore unknown to the steel producers. Aside from molten steel breakouts, which generally occur close to the bottom of the mold 10, the major quality problems are associated with strand surface cracking, both longitudinal and transverse, and entrapped slag inclusions. The most insidious of these defects are the small transverse cracks, invisible on the cold strand surface but visible on the final product. The occurrence of oscillator transverse cracks is a problem which has always accompanied use of the continuous casting process, particularly in certain high strength grades of steel. Of continuously cast steel slabs rejected, as much as 71% of these rejections have been caused by oscillator cracks. After the slabs are cast, they are rolled into plate. As much as 58% of plates produced in a run have been known to be rejected because of oscillator cracks. This can be a significant problem additionally because the oscillator cracks are not always visible to the naked eye. Detection requires dye penetrant inspection, and the probability of detecting all the oscillator cracks on a production basis is very remote. Various methods, metallurgical in nature, have been devised to attempt to deal with this problem, but none have been completely effective. Among these methods are placing restrictions on carbon content, modifying water sprays for strand temperature control, making additions of nickel, vanadium and titanium, revising casting temperatures and placing strict limitations on aluminum and nitrogen. Resorting to mechanical and hand scarfing, or grinding to remove these cracks is uneconomical and precludes direct rolling to save both energy and labor.

The present state of understanding on surface cracking is here summarized. Cracks appear on all grades of structural steels but are predominantly found on the microalloyed high strength low allow (HSLA) steels containing 1.0% manganese and 0.03% niobium (columbium) or vanadium. Cracks are the result of tension stresses applied to the strand surface during the bending or straightening operations. Cracks are generally found only on the top slab surface, i.e. the surface which is in tension when the strand is straightened. However, in severe cases they are found on both surfaces. Microscopic examination of fractures has established that cracking occurs at temperatures equivalent to caster bending and straightening operations; the hot ductility of fractures within the critical temperature range is inversely proportional to grain size; strain and strain rate exceeding that of caster bending and straightening promotes transition from intergranular to transgranular ductile fracture; and cracks initiate at the valleys of oscillator marks and propagate along grain boundaries. Steels exhibit a critical temperature range of low ductility between 1000° C and 600° C, known as the low hot ductility trough, aggravated by additions of niobium. Hot ductility within the trough temperature is further influenced by the strain and strain rate of deformation. The operating parameters of casters restrict the bending or straightening of the strand to the critical temperature range and the strain and strain rate of minimum hot ductility. In the case of the HSLA steels the deformation of bending or straightening promotes dynamic precipitation of carbonitrides such as niobium carbide and aluminum nitrides into and weakening of the grain boundaries. However, the small amount of deformation of bending is insufficient to cause recrystallization and grain refinement. It is noteworthy that precipitation of carbonitrides into the grain boundaries prior to the bending operation would improve ductility. The medium carbon (0.10% to 0.15%) steels exhibit additional crack susceptibility due to the formation of large columnar grains at the strand surface. This phenomenon is associated with the peritectic reaction during solidification of the strand shell in the mold. The columnar grains present grain boundaries particularly vulnerable to fracture by the lengthwise stress of bending.

To reveal these small tears, or oscillator cracks, producers have resorted to machine scarfing the entire surface of the strand preparatory to hand scarfing, or grinding the entire surface in conjunction with die penetrant testing to insure complete removal. This conditioning practice dictates that all steel grades having high "oscillator cracks" incidence be so processed.

SUMMARY OF THE INVENTION

The present invention comprises the bending and unbending of a straight steel strand after it emerges from a straight mold with at least one corrugated roll in the vertical continuous casting process or rolling a curved strand with corrugated rolls after it emerges from a curved mold. The strand can be bent by rolling between a corrugated roll and a smooth roll, or between two corrugated rolls having different sized corrugations. The strand is pushed between the rolls by gravity or by driven rolls such that only compressive stresses are imparted to the strand.

In addition to bending the strand, the corrugated rolls hot work and plastically deform the surface of the steel which makes the surface more resistant to cracking during the bending or unbending operation and subsequent rolling. The columnar grain structure near the surface of the slab is broken up by the high degree of plastic deformation of the surface microstructure. The columnar grains recrystallize to equiaxed grains less likely to yield to tensile stresses. Subsequent rolling of a strand having a corrugated surface also has the benefit of initially imparting only compressive stresses to the strand.

DETAILED DESCRIPTION OF THE INVENTION

My invention relates to a method of mechanically applying a bending load to the strand, at the locations in the continuous caster requiring bending and unbending, which imparts only compressive stresses, and causes the strand to bend to the desired curvature. This method also imparts plastic deformation to the outer surface layers of the strand. With this method of bending the tension stresses are avoided and the strand surface layers are strengthened by breaking up the cast structure and eliminating the oscillator marks.

The bending of the strand is accomplished between a set of two rolls so designed to create unequal pressures and related amounts of plastic deformation to opposite sides of the strand. The unequal volumes of metal plastically deformed on the opposite strand sides translates into unequal amounts of elongation causing bending of the total strand.

For straight mold casters this invention preferably consists of two opposing rolls, one corrugated and one smooth faced, located at the bending and unbending stations of the caster. See FIGS. 2 and 4, respectively. For curved mold casters the invention consists of two opposing rolls corrugated to different degrees, or one corrugated and one smooth, located at the unbending or straightening location. See FIG. 5. The roll corrugations hot work and elongate the strand surface as the strand is pushed between the rolls by the caster drive rolls and by the weight of the strand as in an extrusion process. This compressive force action causes the strand to bend away from the corrugated rolls, or roll of larger corrugations, and results in a slab having a substantially flat, corrugated, hot worked, and notch free surface.

Figure 1:
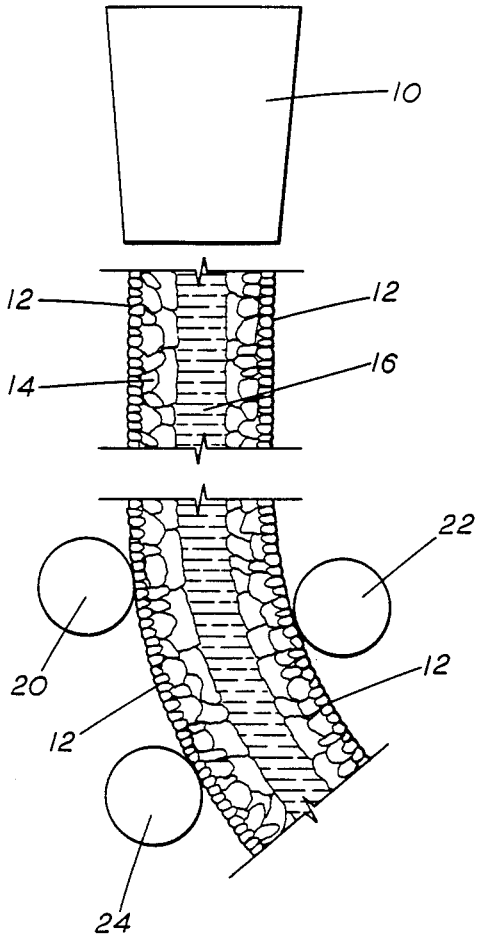
FIG. 1 (PRIOR ART)
FIG. 1 (prior art) is a schematic representation of simple beam bending of the strand in the vertical continuous casting process for manufacturing steel.
Figure 2:
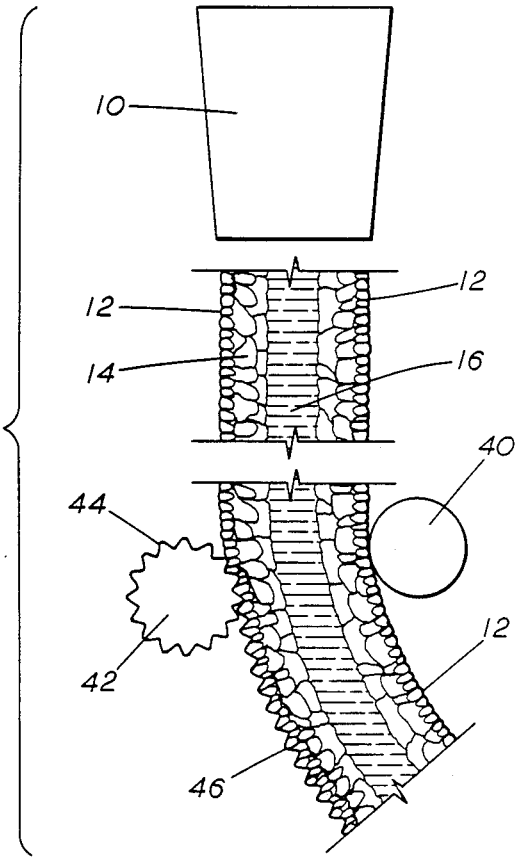
FIG. 2 illustrates the vertical continuous casting process with a corrugated roll 42 opposing a smooth roll 40 for bending the strand.
Figure 3:
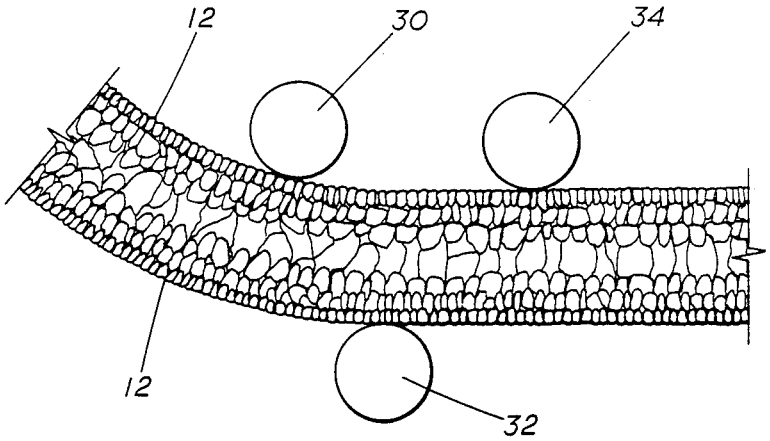
FIG. 3 (PRIOR ART)
FIG. 3 (prior art) is a schematic representation of the simple beam unbending of the strand.

Referring to FIG. 2, one such roll pair design for initially bending the strand into a curve configuration comprises a smooth faced roll 40 contacting the strand on the side intended to be the concave surface, or inside of the bend, and an opposing roll 42 of approximately the same diameter having a series of corrugations 44 on the surface with the ridges and furrows running substantially parallel to the axis of the roll 42. The force applied to the strand by the rolls 40, 42 is thereby distributed unequally on the opposing strand surfaces, the corrugated surface roll 42 having less contacting area than the smooth roll 40 and consequently more pressure per unit of contacting area. With this arrangement a force can be applied which will create pressure on the corrugated points of contact exceeding the compressive yield strength of the strand metal causing plastic flow and elongation of the outer surface 46. The force on the opposite side of the strand is distributed over a larger area of contact and develops pressures either less than the metal compressive yield strength, causing only elastic deformation and no permanent elongation, or more than the metal compressive yield strength but less plastic deformation and elongation than on the corrugated side. As a result, the strand bends toward the smooth roll 40 when the strand is pushed between the smooth roll 40 and the corrugated roll 42.

Figure 4:
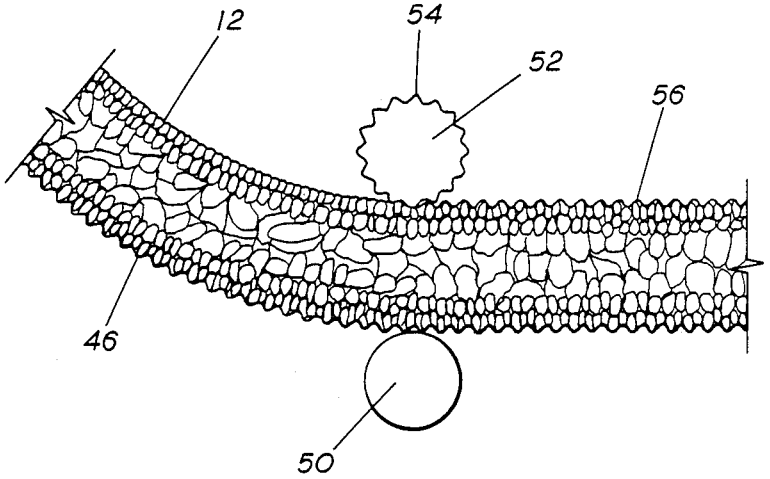
FIG. 4 illustrates the unbending of the strand with a corrugated roll 52 opposing a smooth roll 50.

Referring to FIG. 4, a second roll-pair design for unbending the strand into a flat horizontal position comprises a smooth faced roll 50 contacting the curved strand on the convex surface, or outside of the bend, and an opposing roll 52 of approximately the same diameter having a series of corrugations 54 on the surface with the ridges and furrows running substantially parallel to the axis of the roll 52. With this arrangement, a force can be applied which will create pressure on the corrugated points of contact exceeding the compressive yield strength of the strand causing plastic flow and elongation of the top surface 56 of the strand. As a result, the curved strand is straightened when the strand is pushed between the smooth roll 50 and the corrugated roll 52. The force exerted by the rolls 50 and 52 can be controlled to bend the strand beyond the horizontal position to allow for spring-back to the horizontal position.

Figure 5:
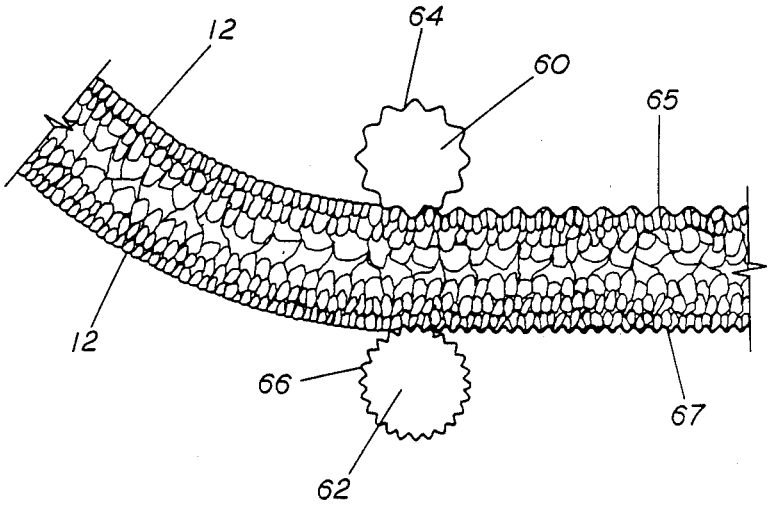
FIG. 5 illustrates the unbending of the strand with two opposing corrugated rolls 60, 62 having different sized corrugation and is useful for continuous casting machines that have curved molds with no initial bending.

Referring to FIG. 5, a third roll-pair alternate design for straightening the curved strand from a curved mold casting process comprises a first corrugated roll 60 contacting the strand on the concave or top surface, and an opposing corrugated roll 62 contacting the strand on the convex or bottom surface. The first corrugated roll has a series of corrugation 64 which are larger than a series of corrugation 66 on the second corrugated roll 62 such that greater elongation is imparted to the top surface 65 than to the lower surface 67. As a result, the curved strand is straightened to the horizontal position when the strand is pushed between the corrugated rolls 60, 62.

This invention was developed to eliminate the conditions that promote the formation of transverse oscillator cracks in steels manufactured by the continuous casting process and to produce a semi-finished slab (bloom) with a surface shape less susceptible to thermal and mechanical ruptures during further processing. The mechanical working of the strand surface 46, 56, 65, 67 breaks up the as-cast dendritic grain structure and irons out the oscillator mark stress risers. The corrugated surface profile of the strand section increases the ratio of surface area to internal volume reducing the susceptibility to surface cracking during cooling from the casting temperature and subsequent reheating for rolling to finished shape.

The reduced susceptibility to cracking of the slab produced by this invention, as compared to the conventional slab, during further processing is related to the surface shape and microstructure. In addition to reshaping of the near-surface grains previously mentioned, impurities are broken up, and pores are eliminated. Steels passing through their transformation temperatures expand upon cooling and contract upon heating creating internal stresses causing surface ruptures when exceeding the ultimate strength of the steel. The corrugated surface design suffers less surface unit elongation for equal internal strain. The wrought surface microstructure increases surface ductility and eliminates the stress riser effect of the oscillator marks by breaking up the near surface columnar grain structure.

The function of the corrugated roll when used opposite a smooth faced roll is to cause plastic deformation to only the strand surface in contact with the corrugations. This results from the smaller areas of contact and higher pressures exerted by the corrugated ridges. In the case of two rolls having different size corrugations, deformation will take place to different degrees on the opposite strand faces. The primary purpose of the two roll set is to bend the strand by compressive forces elongating one surface more than the other. This action also breaks up the surface as-cast structure and removes the oscillator marks. The contour of the corrugations is determined by the strand thickness and caster radius.

Figure 6:
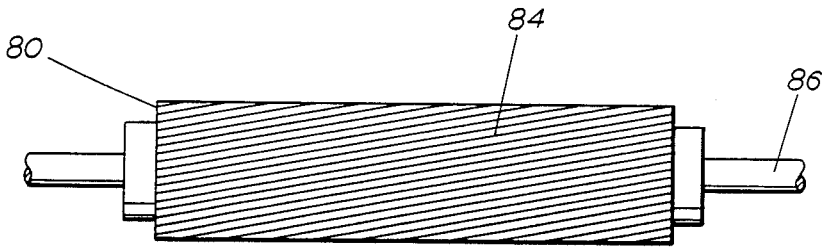
FIG. 6 shows a corrugated roll 80 having angled corrugations 84 to exert an even force against the strand.
Figure 7:
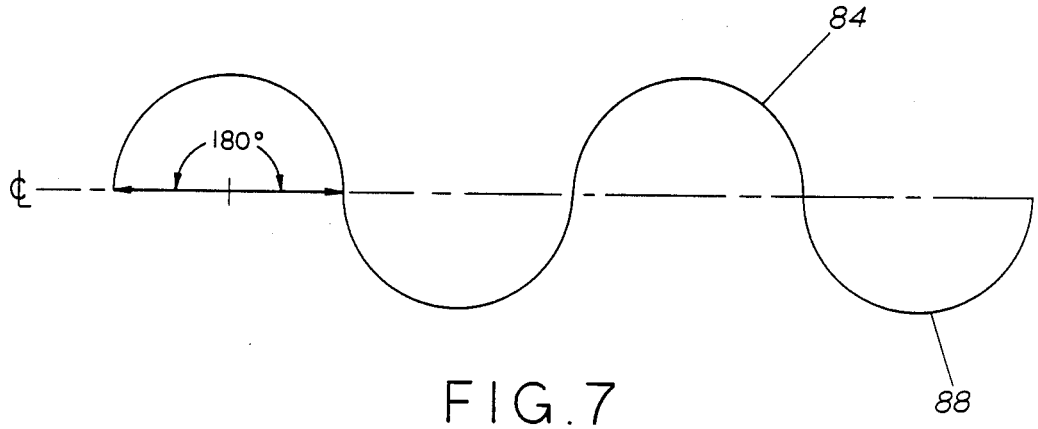
FIGS. 7–9 show several possible surface deformations of the strand which can be controlled by the shape of the ridges and furrows on a corrugated roll.
Figure 8:
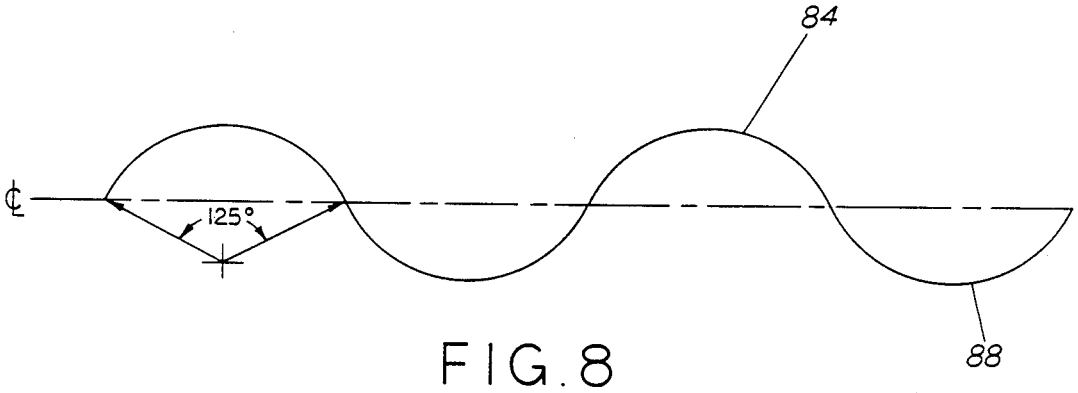
Figure 9:
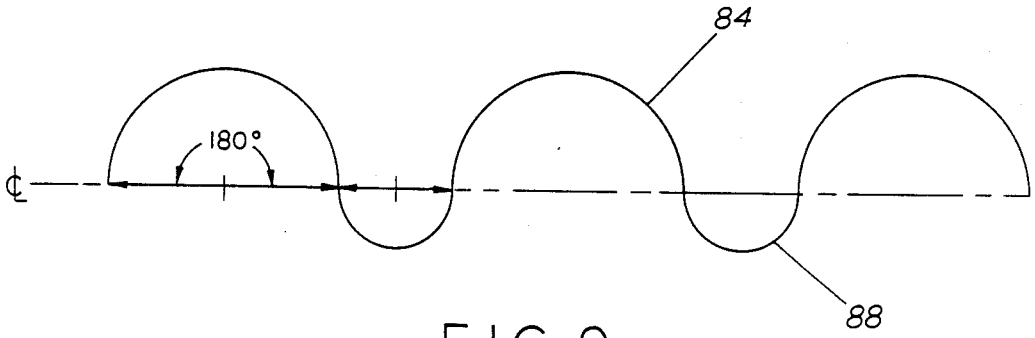

Referring to FIG. 6, the corrugated rolls 80 preferably have corrugated ridges 84 that are angled to the longitudinal roll axis 86. Angling of the ridges 84 evens out the force applied against the strand by the corrugated roll 80 which would otherwise have varying effective diameter depending on whether the roll 80 was contacting the strand at the top of a ridge 84 or between two ridges 84. Typical corrugated roll surface designs are shown in FIGS. 7, 8 and 9 where the corrugated shapes are arcs of a circle. FIG. 9 illustrates larger ridges 84 than furrows 88 as one method to alter surface elongation. Other useful roll surface designs will be readily apparent to persons skilled in the art of making steel and it is only a matter of choice as to which design is best.

Figure 10:
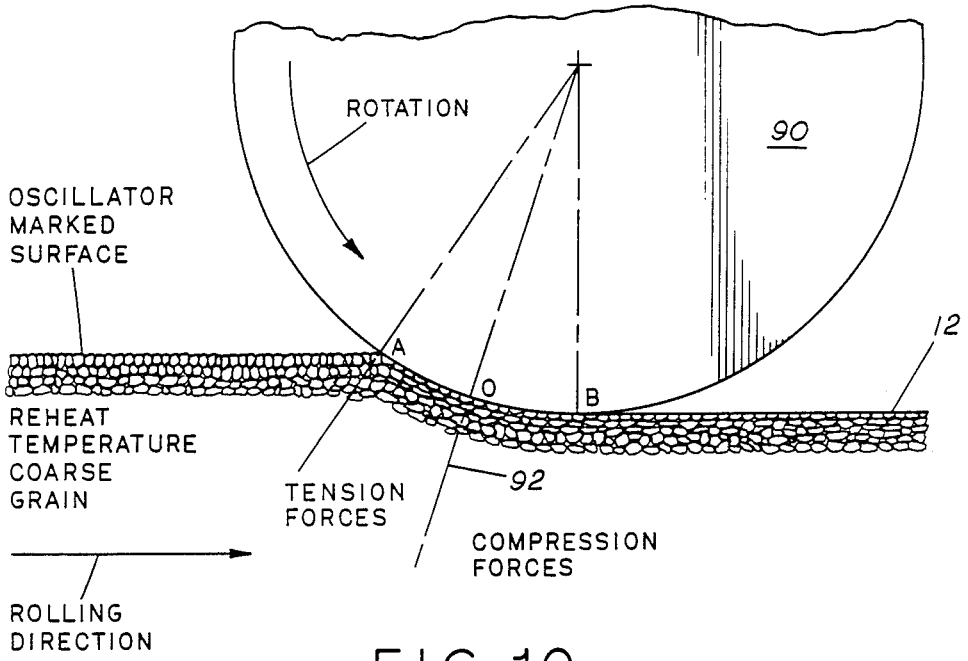
FIG. 10 (PRIOR ART)
FIG. 10 (Prior art) illustrates the rolling of the strand produced by conventional continuous casting process.
Figure 11:
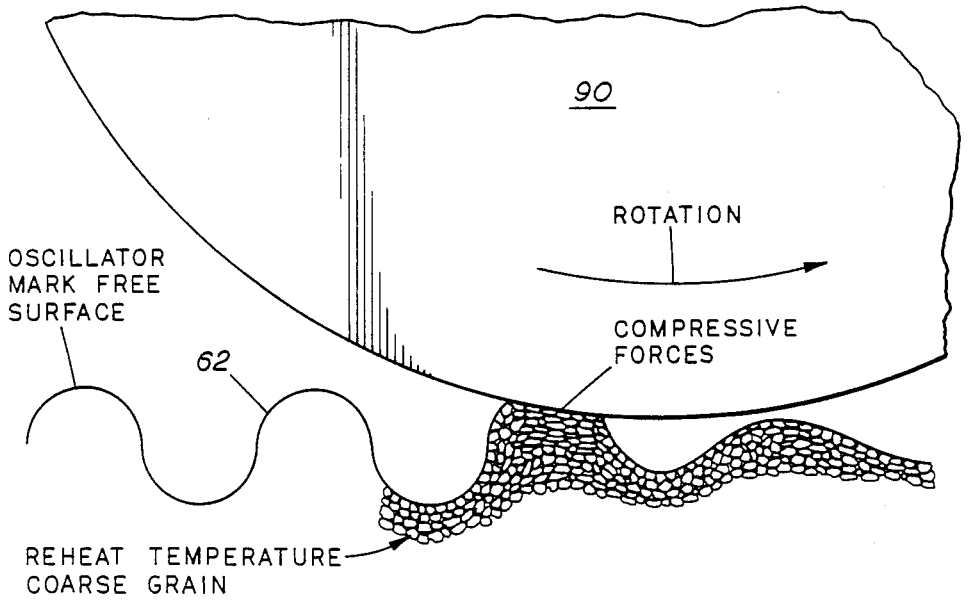
FIG. 11 illustrates the rolling of the strand which has a corrugated surface as a result of bending with a corrugated roll.
Figure 12:
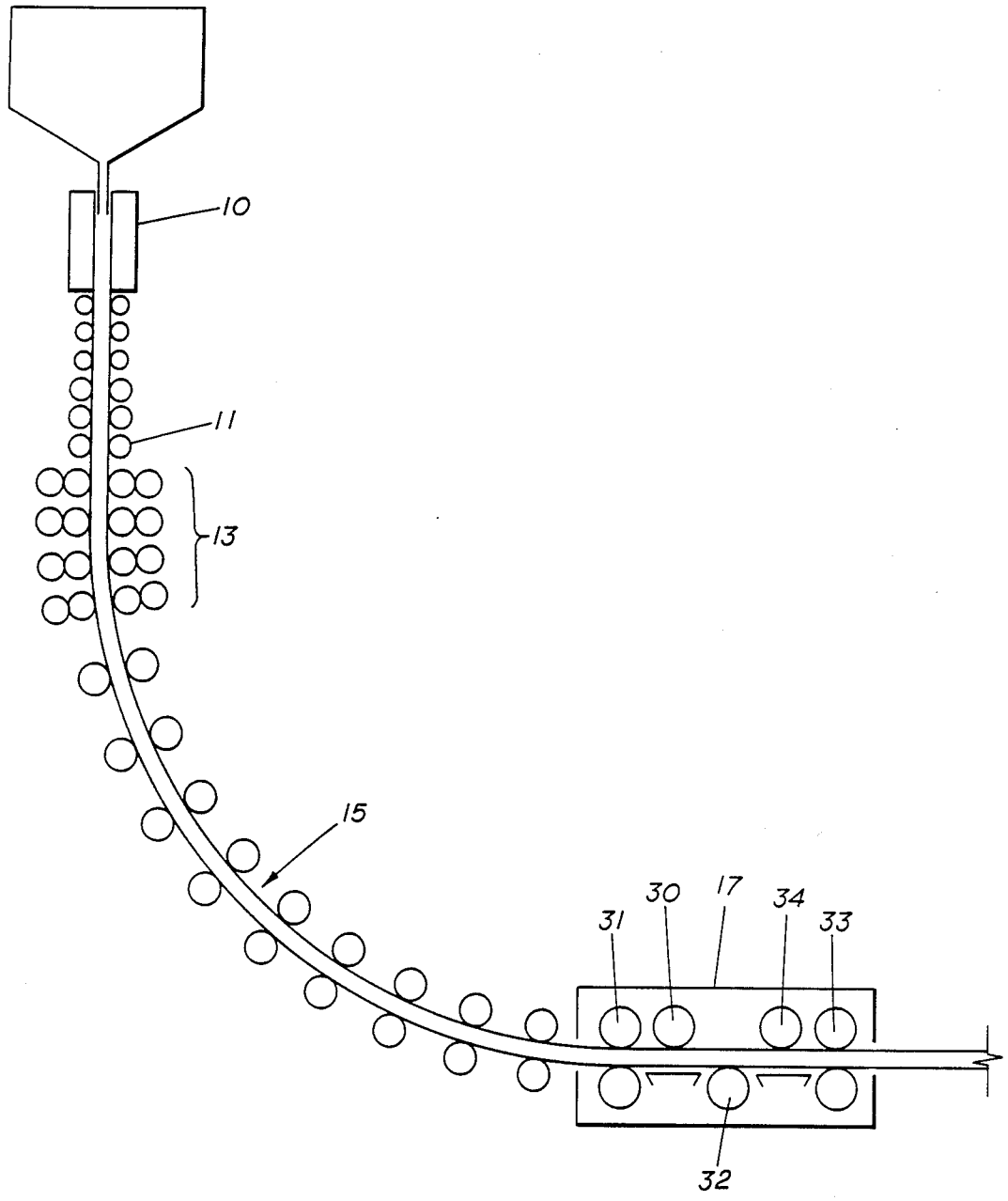
FIG. 12 (PRIOR ART)
FIG. 12 (prior art) illustrates the conventional continuous casting process.

The corrugated slab produced by this invention is less susceptible to surface ruptures than conventional slabs when subjected to the stresses applied during the final rolling operation. See FIGS. 10 and 11. Referring to FIG. 10, during rolling upon a flat surface the first areas of contact between the rolls 90 and the slab receive tension stresses up to the neutral point 92 followed by compressive stresses. Referring to FIG. 11, the initial rolling passes upon a corrugated surface hot work the total surface by compressive forces pressing down on the corrugated peaks. The corrugated slab offers a wrought surface free of oscillator marks for compressive stress hot working prior to the application of the tension stress of later roll passes. During initial light roll passes in the finishing mill, by action of the rolls 90 pushing down on the corrugations, the total surface is worked by compressive stresses. Further rolling leads to the development of smoother surfaces and rolling tension stresses during passes of deeper draft. Industry practice for rolling is to begin with light passes, follow with intermediate deeper drafts, and finish with light passes if required.

Not associated with the surface cracking problem, the corrugated surface as compared to a smooth surface increases fuel heating efficiency in the reheat for rolling, and facilitates primary scale removal during rolling. The increase in heating and cooling efficiency results from additional surface exposure for heat transfer. Further, the corrugated surface has less contact surface with water cooled support skid pipes during heating for rolling which should result in less heat loss and fewer skid marks. As previously described, the initial light roll passes, contacting only the top areas of the corrugations, cause metal deformation in the furrows loosening scale without roll contact.

It is to be understood that the scope of my invention is in no manner limited to the arrangement of equipment as described. Other combinations of roll bending devices that impart only compressive stress bending or surface plastic deformation lie within the scope of this invention.

I claim:

1. An improved continuous casting apparatus which comprises an oscillating mold that forms a strand from molten metal and means for bending the strand, the improvement comprising at least one corrugated roll, having an axis of rotation, for bending the strand by imparting compressive stresses.

2. The apparatus of claim 1, wherein the mold is a vertical oscillating mold from the bottom of which a strand of molten steel issues in a vertical strand;

further comprising a first pair of horizontal cylindrical rolls, for bending the vertical strand to the horizontal, having parallel axes of rotation arranged in a horizontal plane at a substantially equal vertical distance from the oscillating mold, which are spaced so as to bring the cylindrical surfaces of the rolls into contact with opposite sides of the strand of molten steel;

a corrugated cylindrical surface on a first of the rolls having shallow surface corrugations approximately parallel to the axis of rotation of the roll; and a smooth cylindrical surface on a second of the rolls.

3. The apparatus of claim 2, further comprising:

a second pair of horizontal cylindrical rolls, for straightening the bent strand into a horizontal strand, having parallel axes of rotation arranged in a vertical plane, parallel to the axes of rotation of the first pair of rolls, located farther from the corrugated roll than from the smooth roll, spaced so as to bring the cylindrical surfaces of the rolls into contact with opposite sides of the strand of molten steel;

a corrugated cylindrical surface on a first roll of the second pair of rolls, having shallow surface corrugations approximately parallel to the axis of rotation of the roll, located above the strand of molten steel; and a smooth cylindrical surface on a second roll of the second pair of rolls, located below the strand of molten steel.

4. The apparatus of claim 3, wherein the corrugated rolls have their corrugations arranged parallel to their axes of rotation.

5. The apparatus of claim 1, wherein:

the mold is a curved oscillating mold which produces a curved strand of molten steel;

further comprising a pair of horizontal cylindrical rolls having parallel axes of rotation arranged in a vertical plane and spaced so as to bring the cylindrical surfaces of the rolls into contact with opposite sides of the strand of molten steel, a first roll above the strand and a second roll below the strand;

a corrugated cylindrical surface on the first roll having shallow surface corrugations approximately parallel to the axis of rotation of the roll; and a smooth cylindrical surface on the second roll.

6. The apparatus of claim 5, wherein the corrugated roll has its corrugations arranged parallel to its axis of rotation.

7. The apparatus of claim 1, wherein:

the mold is a curved oscillating mold which produces a curved strand of molten steel;

further comprising a pair of horizontal cylindrical rolls having parallel axes of rotation arranged in a vertical plane and spaced so as to bring the cylindrical surfaces of the rolls into contact with opposite sides of the strand of molten steel, a first roll above the strand and a second roll below the strand;

a corrugated cylindrical surface on the first roll having shallow surface corrugations approximately parallel to the axis of rotation of the roll; and a corrugated cylindrical surface on the second roll, having shallower corrugations than the first roll and having its corrugations approximately parallel to the axis of rotation of the roll.

8. The apparatus of claim 7, wherein the corrugated rolls have their corrugations arranged parallel to their axes of rotation.

9. A process for continuously casting a strand of steel, comprising the steps of:

casting a vertical strand of steel with an oscillating mold;

bending the vertical strand into a curved configuration by rolling the strand between a first roll having an axis of rotation, and having shallow surface corrugations approximately parallel to the axis of rotation, and a first smooth roll; and straightening the curved strand into a horizontal position by rolling the strand between a second corrugated roll having an axis of rotation, and having shallow surface corrugations approximately parallel to the axis of rotation, and a second smooth roll.

10. The process of claim 9, wherein the corrugated rolls have corrugations parallel to their axes of rotation.

11. A process for continuously casting a strand of steel, comprising the steps of:

casting a curved strand of steel with a curved oscillating mold; and straightening the curved strand into the horizontal position by rolling between a first corrugated roll having an axis of rotation and a second corrugated roll having an axis of rotation, the first and second corrugated rolls having different sized surface corrugations approximately parallel to the axis of the roll.

12. The process of claim 11, wherein the corrugated rolls have corrugation parallel to their axes of rotation.

* * * * *